US005347714A

United States Patent [19]

Prochaska

[11] Patent Number: 5,347,714

[45] Date of Patent: Sep. 20, 1994

[54] MOVABLE BLADE SHAVING CARTRIDGE

[75] Inventor: Frank H. Prochaska, Waynesboro, Va.

[73] Assignee: American Safety Razor Company, Verona, Va.

[21] Appl. No.: 19,290

[22] Filed: Feb. 18, 1993

[51] Int. Cl.[5] ..... B26B 19/44; B26B 21/00; B26B 21/16

[52] U.S. Cl. ..... 30/41.5; 30/32; 30/50

[58] Field of Search ..... 30/48, 50, 51, 54, 57, 30/72, 41.5, 32, 79, 80

[56] References Cited

U.S. PATENT DOCUMENTS

| | | | |
|---|---|---|---|
| 2,704,397 | 3/1955 | Turgi | 30/32 |
| 3,054,181 | 9/1962 | Kitashiro | 30/32 |
| 3,724,070 | 4/1973 | Dorion, Jr. | 30/47 |
| 3,786,563 | 1/1974 | Dorion, Jr. et al. | 30/50 |
| 3,890,704 | 6/1975 | Ferraro | 30/47 |
| 3,934,338 | 1/1976 | Braginetz | 30/47 |
| 3,938,247 | 2/1976 | Carbonell et al. | 30/47 |
| 3,950,849 | 4/1976 | Perry | 30/47 |
| 4,026,016 | 5/1977 | Nissen | 30/47 |
| 4,063,354 | 12/1977 | Oldroyd et al. | 30/47 |
| 4,069,580 | 1/1978 | Cartwright et al. | 30/47 |
| 4,094,063 | 6/1978 | Trotta | 30/47 |
| 4,168,571 | 9/1979 | Francis | 30/47 |
| 4,170,821 | 10/1979 | Booth | 30/41 |
| 4,184,246 | 1/1980 | Trotta | 30/47 |
| 4,270,268 | 6/1981 | Jacobson | 30/47 |
| 4,272,885 | 6/1981 | Ferraro | 30/47 |
| 4,335,508 | 6/1982 | Francis et al. | 30/47 |
| 4,403,412 | 9/1983 | Trotta | 30/47 |
| 4,403,413 | 9/1983 | Trotta | 30/47 |
| 4,461,079 | 7/1984 | Ciaffone et al. | 30/79 |
| 4,488,357 | 12/1984 | Jacobson | 30/57 |
| 4,498,235 | 2/1985 | Jacobson | 30/47 |
| 4,574,476 | 3/1986 | Ortiz | 30/47 |
| 4,641,429 | 2/1987 | Abatemarco | 30/41 |
| 4,739,553 | 4/1988 | Lazarchik | 30/47 |
| 4,785,534 | 11/1988 | Lazarchik | 30/50 |
| 4,932,123 | 6/1990 | Francis | 30/77 |
| 4,939,840 | 7/1990 | Butka | 30/37 |
| 5,029,390 | 7/1991 | Reeves | 30/32 |
| 5,060,377 | 10/1991 | Althaus et al. | 30/50 |
| 5,070,612 | 12/1991 | Abatemarco | 30/50 |
| 5,222,300 | 6/1993 | Althaus et al. | 30/50 |
| 5,251,376 | 10/1993 | Althaus et al. | 30/50 |
| 5,253,420 | 10/1993 | Althaus et al. | 30/50 |

FOREIGN PATENT DOCUMENTS 5-192 1/1993 Japan .

*Primary Examiner*—Richard K. Seidel
*Assistant Examiner*—Paul M. Heyrana, Sr.
*Attorney, Agent, or Firm*—Willian Brinks Hofer Gilson & Lione

[57] ABSTRACT

A razor head comprises a body portion defining a guard and a cap, and a blade assembly having a blade disposed therein. The blade assembly is mounted by a first and second mounting member to the body portion in relation to the guard and cap in a manner to comprise a four-bar linkage. The body portion defines a stationary member of the four-bar linkage. The first and second mounting members each have one end connected to the body portion in a manner to define rotational members of the four-bar linkage about a separate axis of rotation for each of the first and second mounting members. The blade assembly is connected to the other end of the first and second mounting members to define a movable four-bar member responsive to rotational movement of the first and second mounting members so that shaving forces acting upon the blade assembly cause the blade assembly to move relative to the body portion.

42 Claims, 8 Drawing Sheets

MOVABLE BLADE SHAVING CARTRIDGE

BACKGROUND OF THE INVENTION

The present invention relates to wet shaving systems of the blade type and more particularly to a shaving system having a movable blade positioned within a shaving cartridge or the like.

During the shaving process, shavers have long sought a wet shaving system which provides a smooth and comfortable shave without having annoying cuts and abrasions caused by the blade being at the wrong exposure and shave angle in response to shaving forces. For example, various approaches have been used to enable the shaving blade to move relative to the shaving cartridge or razor body in response to shaving forces encountered during the shaving process in an effort to present the correct blade exposure and shave angle.

One approach disclosed in prior art patents illustrates a blade cartridge comprised of two blades separated by a spacer with the blades and the spacer attached to a cap to form a unitary assembly. The blade assembly may be movable to various blade exposure and shave angles within various degrees of control and direction in response to forces encountered during shaving. For example, Ciaffone et al., U.S. Pat. No. 4,461,079, discloses a razor cartridge comprising a cartridge body 10 which includes a guard bar 12 (FIGS. 1–5). The guard bar 12 defines a leading skin-engaging surface fixed to the cartridge body. A rear beam 17 spans end walls 14 and 16 of the cartridge body 10 and a medial support member 13 to join the front of the cartridge 12 to the end thereof. A plurality of generally flat coplanar segments 18,19,21,22, each having an opening 23, are hinged to the rear beam 17 by mating webs 24,26,27,28 (col. 2, lines 50–52). Collectively, the segments 18,19,21,22 define a blade seat which is operable to pivot about the beam 17, thereby changing the attitude of blade edge relative to guard bar 12 (col. 2, lines 53–57). A cap 33 is apparently placed above an assembly of two skin-engaging blades 34,36, straddling a spacer 37 (FIG. 3). The two blades and the spacer are secured to one coplanar segment 21 of the blade support or blade seat by a conventional rivet 38 to form a rigid unit. A hinge 27 connects the coplanar segment 21 to the rear-beam 17 (col. 3, lines 1–8). As compared to the position of the blade edges relative to the guard bar at the normal or free position set in accordance with a predetermined blade geometry (FIG. 3), a change in blade geometry occurs during the course of shaving when a shaving force F causes the blade package to rotate or pivot about rear-beam 17 in the direction of arrow R where the blade edges are rendered less "aggressive" (FIG. 4, col. 3, lines 13–23). Upon relaxation of shaving forces, the elastic memory of hinges 24,26,27,28 forces the blade seat, and therefore the blade edges, to return to their normal position (FIG. 3., col. 3, lines 24–26).

In an alternative embodiment, Ciaffone et al. shows the blade seat is hinged to a front beam 175 by webs 240,260,270,280 (FIGS. 6–10, col. 3, lines 46–48). Upon exertion of a shaving force F′ (FIG. 9) onto the cap 330, the coplanar segments 180,190,210 and 220, move in the direction of the arrow R (FIG. 9) to provide a more aggressive edge exposure (col. 4, lines 1–9). As in the embodiment of FIGS. 1–5, the elastic memory of the hinges 240,260,270,280 forces the blade edges to return to the free position when shaving forces are released (col. 4, lines 11–13).

Oldroyd et al., U.S. Pat. No. 4,063,354, discloses a shaving unit wherein a blade unit comprises two blades separated by a spacer 5 (FIGS. 13–16). A resiliently flexible metallic or plastic guard 3 is secured to the blade unit by spot welding or other means (col. 3, lines 26–28). The blade unit, which is illustrated in its normal forward position of maximum blade exposure in FIG. 13, can bow rearwardly under pressure applied during shaving to carry the blade unit along a plane to the rear, relative to the platform 1 and cap 4. This reduces blade exposure but increases the shaving angle, as indicated by dotted lines 3′ in FIGS. 13 and 15 (col. 3, lines 26–37).

Althauset et al., U.S. Pat. No. 5,074,042, discloses a shaver head comprising two staggered blades 7 embedded in a blade block 6 (FIG. 3). A cover cap portion 9 covers the top side of the blade block 6 (col. 3, lines 12–15). A spring 14 is placed between the blade block 6 and a body 2. The blade block 6, together with the two staggered blades 7, can swivel about an axis A (col. 3, lines 17–43). During shaving, pressure is applied to the razor blade unit, thereby causing the blade block 6 to swivel and alter shaving geometry of the blades (col. 3, lines 46–60).

Jacobson U.S. Pat. Nos. 4,442,598, 4,378,634 and 4,270,268 disclose a razor blade assembly including a body member 2 having blade means 36,36′ being independently movable in response to spring finger biasing means 18,18′ integral with the body member. In the Jacobson patents, the spring fingers 18,18′ move the blade means 36,36′ along planes defined by slots 16 in end portions 4,6 of the body member 2.

None of the patents described above provides the important advantages of using the combination of front and rear double cantilevered springs to support a blade assembly within a body portion of a shaving cartridge or the like to precisely control blade geometry of exposure and shaving angle in response to shaving forces. None of the prior art patents use a four-bar linkage formed by the combination of rotatable front and rear double cantilever springs (or links) connected to a stationary and movable blade assembly to translate shaving forces encountered from any direction into predictable and precisely controlled blade movement to achieve the correct exposure and shave angle.

SUMMARY OF THE INVENTION

According to the invention, a razor head comprises a body portion defining a guard and a cap. A blade assembly has a blade disposed therein and is mounted by a first and second mounting member to the body portion in relation to the guard and cap in a manner to comprise a four-bar linkage.

As pointed out above, the body portion of the razor head defines a stationary member of the four-bar linkage. The first and second mounting members each having one end connected to the body portion in a manner to define rotational members of the four-bar linkage about a separate axis of rotation for each of the first and second mounting members. The blade assembly is connected to the other end of the first and second mounting members to define a movable four-bar member responsive to rotational movement of the first and second mounting members so that shaving forces acting upon the blade assembly cause the blade assembly to move relative to the body portion.

Preferably, the four-bar linkage causes the angle of the blade in said blade assembly to become either more of less aggressive in response to shaving forces acting upon the blade assembly.

More preferably, the first and second mounting members comprise cantilever springs or members which deflect or rotate or translate upon response to encountered shaving forces.

Still further within the spirit of the invention, the first and second mounting members may define varying resilient characteristics between the body portion and blade assembly. Also, one of the mounting members may include first and second elements defining a second axis of rotation for the mounting member in manner that the body portion, the blade assembly and the first and second mounting members comprise a five-bar linkage.

Preferably, the razor head may be connected to a handle, and may be pivotally connected to allow the razor head to further respond to shaving forces encountered during the shaving process.

As pointed out in greater detail below, this invention provides important advantages. The combination of front and rear double cantilevered springs to support a blade assembly within a body portion of a shaving cartridge or the like precisely controls blade geometry in response to shaving forces. Also, the four-bar linkage formed by the combination of rotatable front and rear cantilever springs connected to the stationary and movable blade assembly translates the shaving forces encountered from any direction into predictable blade movement in a safe direction from exposure and shave angle considerations.

The invention itself, together with further objects and attendant advantages, will best be understood by reference to the following detailed description taken in conjunction with the accompanying drawings.

DETAILED DESCRIPTION OF THE INVENTION

Figure 1:
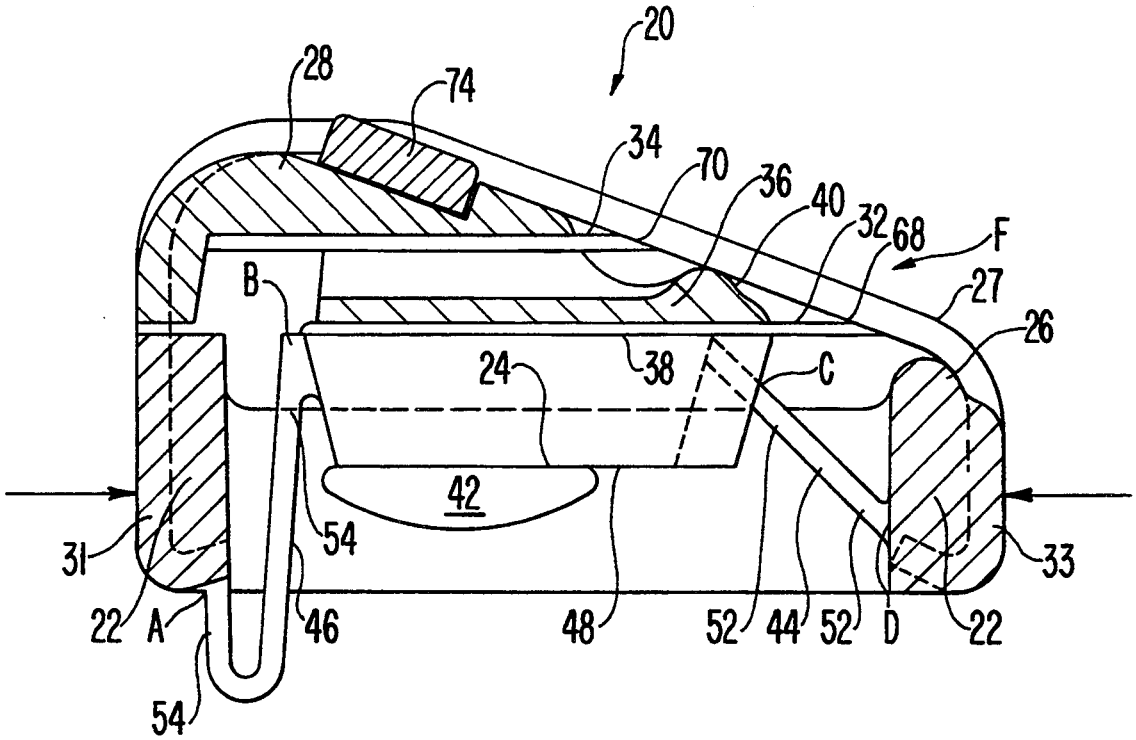
FIG. 1 shows a cross section of the razor head (or blade cartridge) of the present invention showing the blade assembly mounted to the blade seat platform on the body portion or cartridge body.

Turning now to the drawings, FIGS. 1–7 show a moveable blade shaving cartridge ("MBSC" or shaving cartridge) or razor head 20 which comprises a body portion 22 having a unitary blade assembly 24 positioned between a guard 26 and cap 28. Ends 27,29 provide structural strength to the razor head 20.

Figure 12:
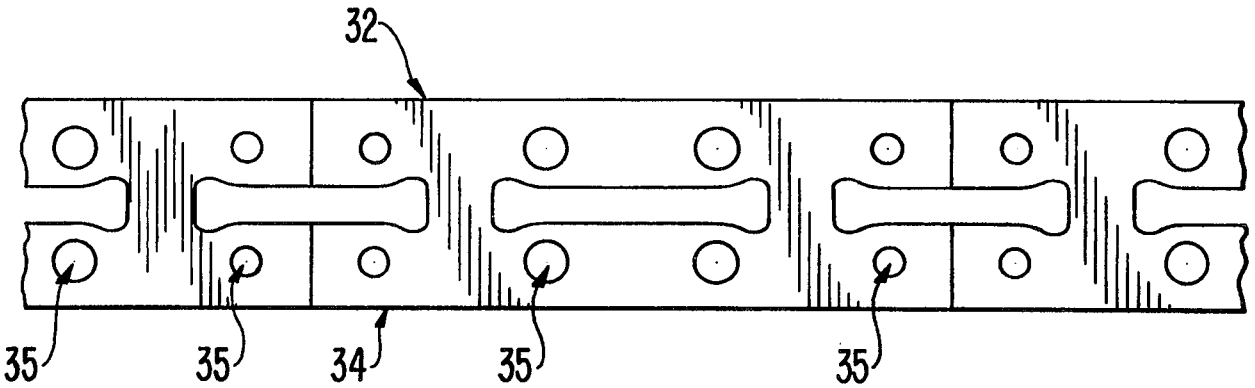
FIG. 12 shows a blade used for the primary or secondary blade structure.

Preferably, as shown in FIG. 1, the blade assembly 24 comprises two blades 32,34 with the primary blade 32 and a secondary blade 34 separated from each other by a distance of about 0.20 inches to about 0.035 inches. As illustrated in FIG. 12, the blades 32,34 have a plurality of holes 35 through which fastening means, such as rivets (not shown) may affix the blades 32,34 together to form a unitary assembly.

Figure 2:
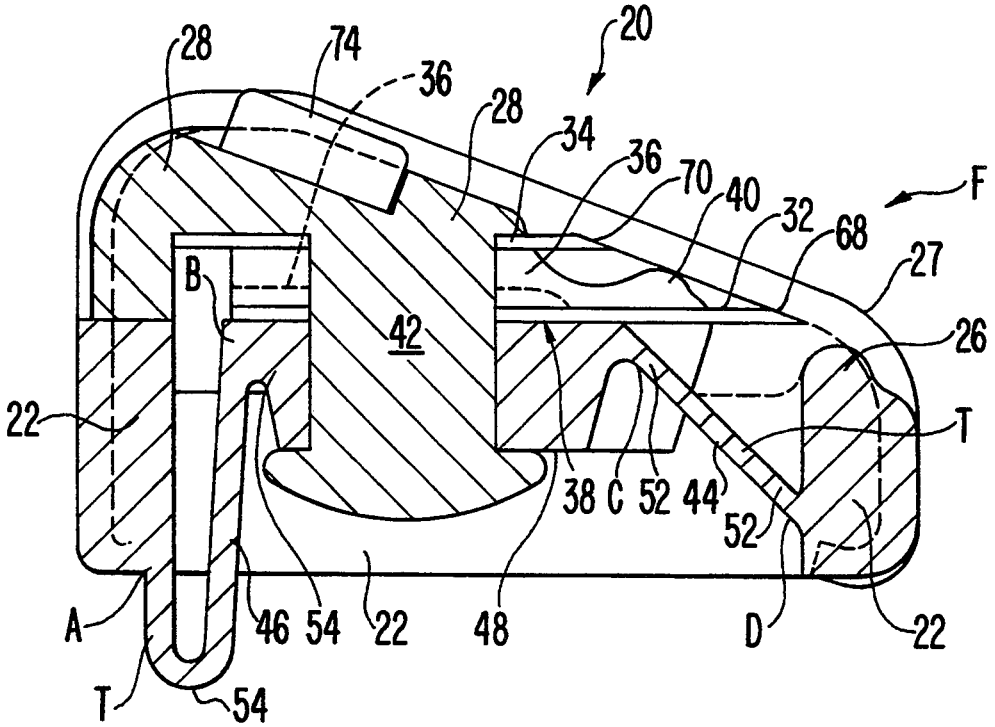
FIG. 2 shows a cross section of the blade cartridge of the present invention through the rivet on the cap holding the blade assembly to the platform formed by seats on the cartridge body.

As shown in FIGS. 1 and 2, a spacer or "soap bar" 36 is placed between the primary and secondary blades 32,34. The blades 32,34 are held against both sides of the spacer 36, and they are attached to the cap 28 and a cartridge platform 38 by a plurality of rivets 42. The unitary blade assembly 24 is mounted to the razor head or shaving cartridge 20 by a first and second mounting member 44,46 affixed to the body portion 22 in relation to the guard 26 and cap 28 in a manner to comprise a four-bar linkage AB,BC,CD,AD.

Figure 3:
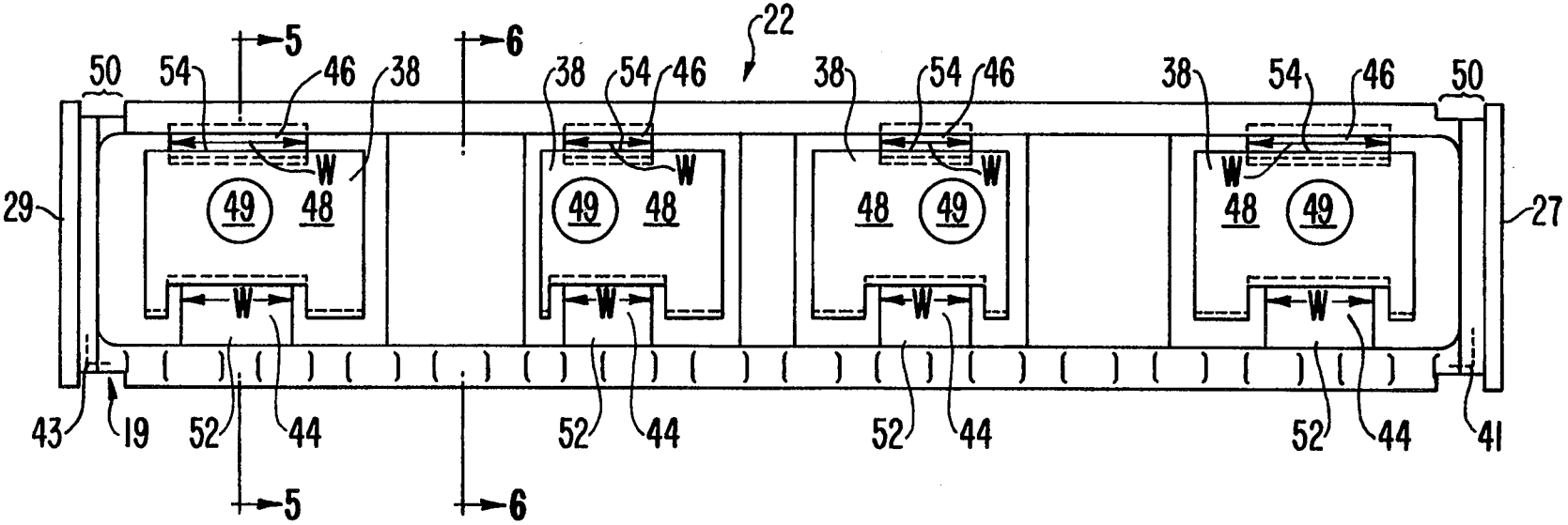
FIG. 3 shows a top plan view of the cartridge body of the present invention showing the plurality of seats formed on the cartridge body to define the platform.
Figure 4:
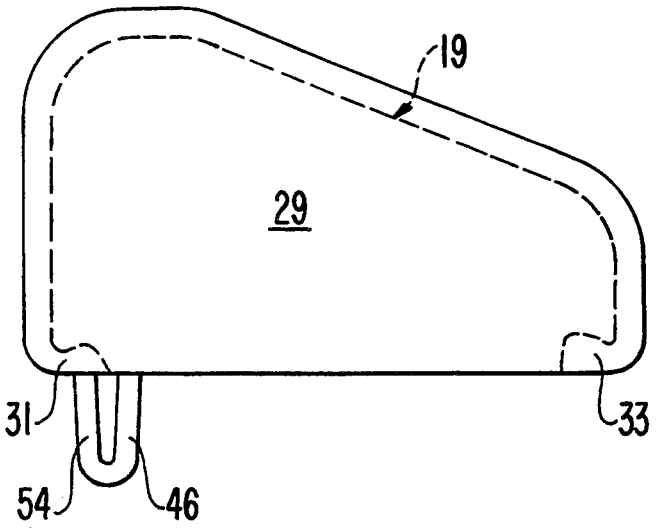
FIG. 4 shows an end view of the cartridge body of FIG. 3.
Figure 5:
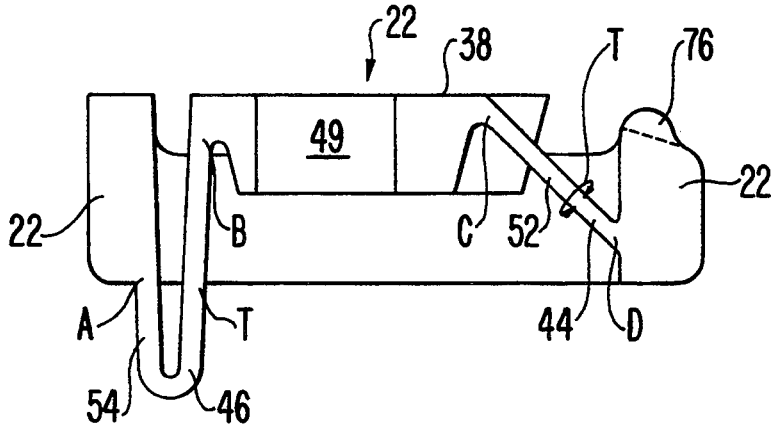
FIG. 5 is a cross section taken along line 5—5 of FIG. 3.
Figure 6:
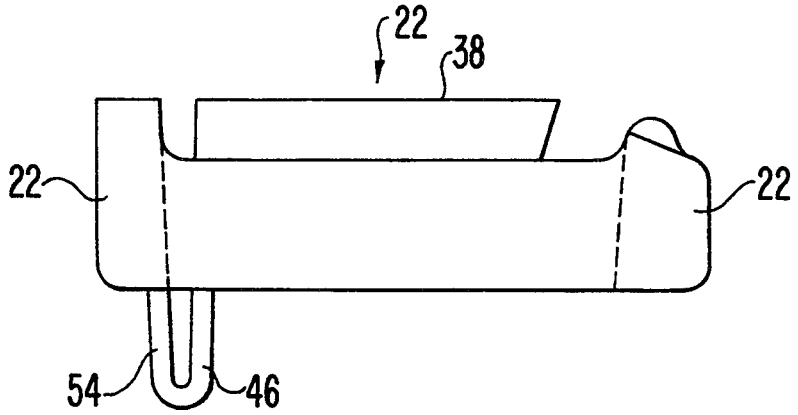
FIG. 6 is a cross section taken along line 6—6 of FIG. 3.

As best shown in FIGS. 2–6, the cap 28, the two blades 32,34 and the spacer 36 form the blade assembly 24 which, as illustrated in FIGS. 4, 5 and 6, is supported on four substantially rectangular pads or seats 48 formed on the body portion 22 to form the cartridge platform 38. As illustrated in FIGS. 2 and 3, each of the four rivets 42 attaches the blade assembly 24 to the rectangular pads 48 through openings 49 on the body portion 22.

The blade assembly may also include the cap 28 shaped at each end to limit the rear movement of the blade assembly 24. The forward position of the blade assembly 24 relative to the guard 26 is set by the corners of the blades contacting the corners of the blades 32,34 with end bails 19. As shown in FIGS. 1, 2 and 4, the end bails 19 are generally in a "C" shape which wraps around the blade assembly 24 with its legs 31,33 disposed to fit within grooves 50 formed on the body portion 22 to cover the corners 41,43 of the blades 32,34. In this manner, the translation and rotational movement of the blade assembly 24 in response to shaving forces is controlled by the pairs of double cantilever springs 52,54 between the forward position of the blades and the rearward limit.

As shown in FIGS. 3–6, each of the rectangular seats 48 are supported by first and second mounting members 44,46, preferably front and rear double cantilever springs 52,54, which are respectively integrally formed on body portion 22. Typically, at least a pair of front (first) and rear (second) mounting members 44,46 affix the blade assembly 24 to the body portion 22, with front and rear double cantilever springs 52,54 supporting each blade seat or seat 48. Preferably, as illustrated in FIG. 3, four seats 48 are used to support the blade assembly 24.

Figure 8:
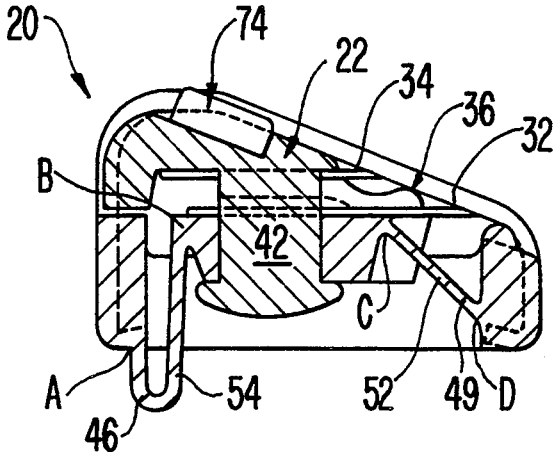
FIG. 8 is a cross section of the blade cartridge through the rivet on the cap holding the blade assembly to the platform on the cartridge body which illustrates the application of shaving forces upon the blades to move the blade assembly of the present invention.
Figure 9:
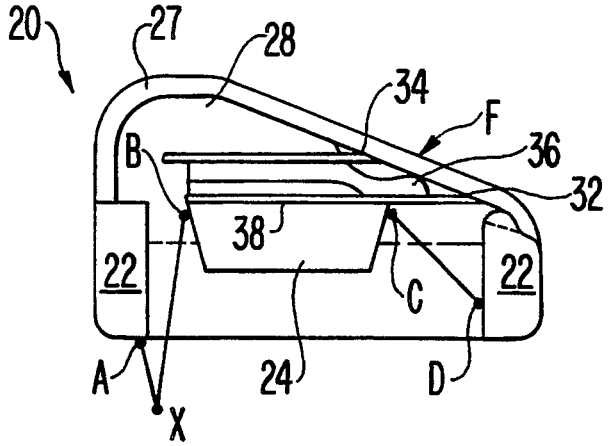
FIG. 9 shows a schematic cross section of the four-bar linkage of the shaving cartridge of the present invention prior to rotational and translational movement due to shaving forces.
Figure 10:
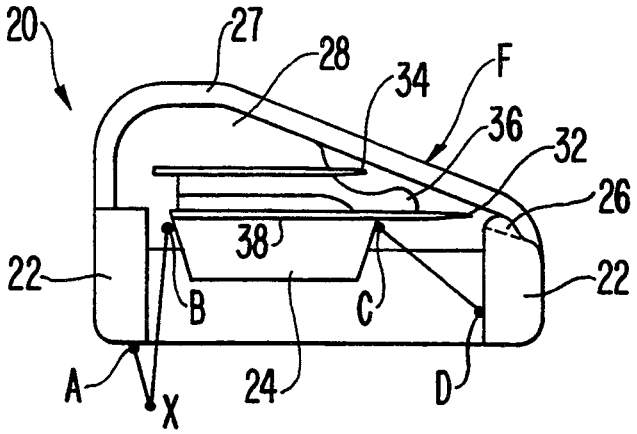
FIG. 10 shows a schematic cross section of the four-bar linkage shaving cartridge of the present invention after movement due to shaving forces.

As illustrated in FIGS. 8, 9, and 10, the body portion 22 defines a stationary member or link AD of the four-bar linkage AB,BC,CD,AD. The first and second mounting members 44,46 each have one end connected to the body portion in a manner to define rotational members or link AB,CD of the four-bar linkage AB,BC,CD,AD about a separate axis of rotation for each of the first and second mounting members 44,46. The blade assembly 24 is connected to the other end of the first and second mounting members 44,46 to define a movable member or link BC of the four-bar linkage AB,BC,CD,AD. The four-bar linkage AB,BC,CD,AD is responsive to rotational movement of the first and second mounting members 44,46 so that shaving forces F acting upon the blade assembly cause the blade assembly to precisely move relative to the body portion 22 and control blade geometry in response to the shaving forces F. The four-bar linkage is accomplished by having rotational link AB define a thickness and width which renders it relatively fixed from the body portion 22 to the bottom of the "U" shape formed by rotational link AB. By varying the thickness and width of the remainder of rotational member AB, a flexible double cantilever spring 46 is formed to define rotational link AB of the four bar linkage AB,BC,CD,AD.

As illustrated in FIG. 10, and merely by way of example, if the pressure encountered by the blade assembly 24 during shaving exceeds that of the force of the double cantilever spring load 52,54 the entire blade assembly 24 moves, thereby forcing the blades 32,34 to move in a translational and/or rotational direction away from the surface being shaved and adjust to a lower, safer shave angle and exposure.

The use of the term "rotational" includes the relative motion of a member having one end generally connected about a fixed point or axis such that when the other end is rotated, moved, deflected, distorted or the like relative motion is defined between the respective ends of the member. Merely by way of example, the first and second mounting members 44,46 comprising double cantilever springs 52,54 rotate, or deflect about an axis generally defined near the end of each mounting member 44,46 interconnected to the body portion 22 such that the opposite end displays a defined relative motion and/or acceleration relative to the generally fixed end or axis of each mounting member 44,46. Also, the first and second mounting members 44,46 may define varying resilient characteristics between the body portion 22 and blade assembly 24 fixed upon the seats 48, e.g., by varying the thickness or width, "T" or "W" respectively, of the double cantilever springs 52,54.

By the way of example, the four-bar linkage AB,BC,CD,AD formed by the combination of rotatable front and rear cantilever springs 52,54 connected to the stationary link AD and movable blade assembly link BC translate the shaving forces F encountered from any direction into predictable blade 32,34 movement in a safe direction from exposure and shave angle considerations. For example, the four-bar linkage AB,BC,CD,AD may cause the angle of the blades 32,34 in the blade assembly 24 to become either more or less aggressive in response to shaving forces F acting upon said blade assembly 24, or cause the blade assembly 24 to move away from the shaving forces F acting upon the blades 32,34. It is within this context that the term "rotation" (or "rotational") is used to define the movement of the blade assembly 24 in response to shaving forces F to change the shaving angle. Further, the use of the term "translational" defines the movement of the blade assembly 24 about an axis defined by the seats 48 and blades 32,34 in response to shaving forces F in a manner to decrease (or increase) blade exposure relative to the guard 26 and cap 28. The blade assembly 24 may move separately by rotation or translation to define the shave angle and exposure of the blade or by a combination of rotational or translational movements.

Figure 7B:
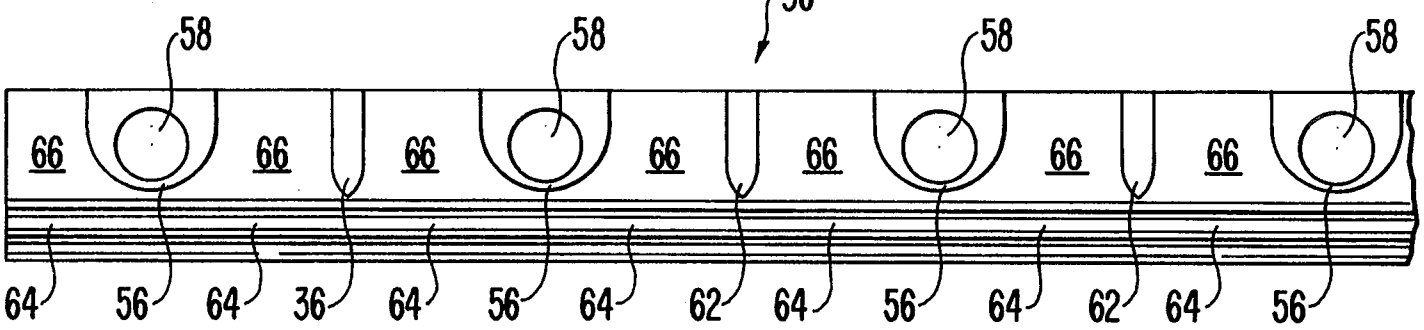
FIG. 7 shows a blade spacer for use in the blade cartridge of the present invention.
Figure 7A:
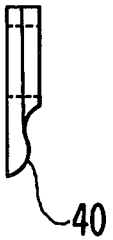

As illustrated in FIGS. 1, 2 and 7, the guard or primary soap bar 26 placed in front of the primary blade 32 is stationary and does not move with the blade assembly 24. The spacer 36 is designed to provide easy egress for the debris to exit the shaving cartridge 20. Similar to the guard 26 being positioned in front of the primary blade 32, the spacer 36 has a raised oval or round skin engaging portion 40, which provides an engaging surface to control exposure of the secondary blade 34 to the shaver's skin. The spacer 36 includes arcuate or rounded protrusions 56 formed around an opening 58 for the rivets 42, and tapered or pointed projections 62 are formed therebetween to define channels 64 to define numerous tunnels 66 when the blades 32,34 are mounted on top and bottom of the spacer 36. The tunnels 66 connect the area between the blades 32,34 with the interior of the shaving cartridge 20, thereby allowing shaving debris to flow away from the secondary blade 34 and be led out the back of the shaving cartridge 20 by the internal design of the cap 28 and seats 48. Conversely, water can be directed into the back of the shaving cartridge 20 to be channeled out through the front of the cartridge past edges 68,70 of the blades 32,34.

Variations on the embodiments described above are possible. For example, at least one of one mounting members, such as links AB,CD, may include first and second elements (such as links AX,XB) which define a second axis of rotation for one of the mounting members 44,46 in manner that the body portion 22, the blade assembly 24 and the first and second mounting members 44,46 comprise a five-bar linkage AX,XB,BC,CD,AD. Further, the first and second elements of the mounting members 44,46 may define first and second elements (or links AX,XB) having unequal radii of rotation. Still further, the first and second elements (or links AX,XB) of one of the mounting members 44,46 may define an axis of rotation extending beyond the body portion 22, and the other of the second elements (AX or XB) define an axis of rotation generally within the body portion 22. As shown in FIGS. 9 and 10, the five-bar linkage AX,XB,BC,CD,AD is accomplished by having rotational links AX and XB define a suitable width and thickness of the cantilever spring 46 which allows links AX and XB to rotate or pivot about points A and X, respectively. In this manner, two moving members XB and BC of the five-bar linkage AX,XB,BC,CD,AD are defined.

In another variation, the guard 26 may include means to allow independent movement of the guard 26 in the direction away from the direction of shaving forces acting upon the guard 26. Jacobson U.S. Pat. Nos. 4,442,598, 4,378,634 and 4,270,268 disclose a razor head having movable guard means. Similarly, the cap 28 may include means to allow independent movement in a direction away from the direction of shaving forces acting upon said cap. Oldroyd et al., U.S. Pat. No. 4,063,354, discloses a shaving unit having a movable cap suitable for use with this invention.

In yet another variation, a shaving aid 72 may be affixed or included with the razor head. Typically, as shown in FIG. 1, the shaving aid 72 comprises a polystyrene-polyethylene oxide blend in the form of lubricating strip 74, which may be positioned behind the secondary blade 34. During shaving, the polyethylene oxide bleaches out of the styrene matrix. Other suitable shaving aids for use with the invention are also described in U.S. Pat. No. 4,170,821 issued to Booth entitled "Razor Cartridges." Preferably, the shaving aid 72 comprises a matrix of polystyrene, polyethylene oxide and aloe and/or vitamin E. Also, the shaving aid 72 may define a lubrication strip 76, shown in dotted lines in FIG. 5, positioned near the guard, either separately or in combination with the cap lubrication strip 74.

Figure 13:
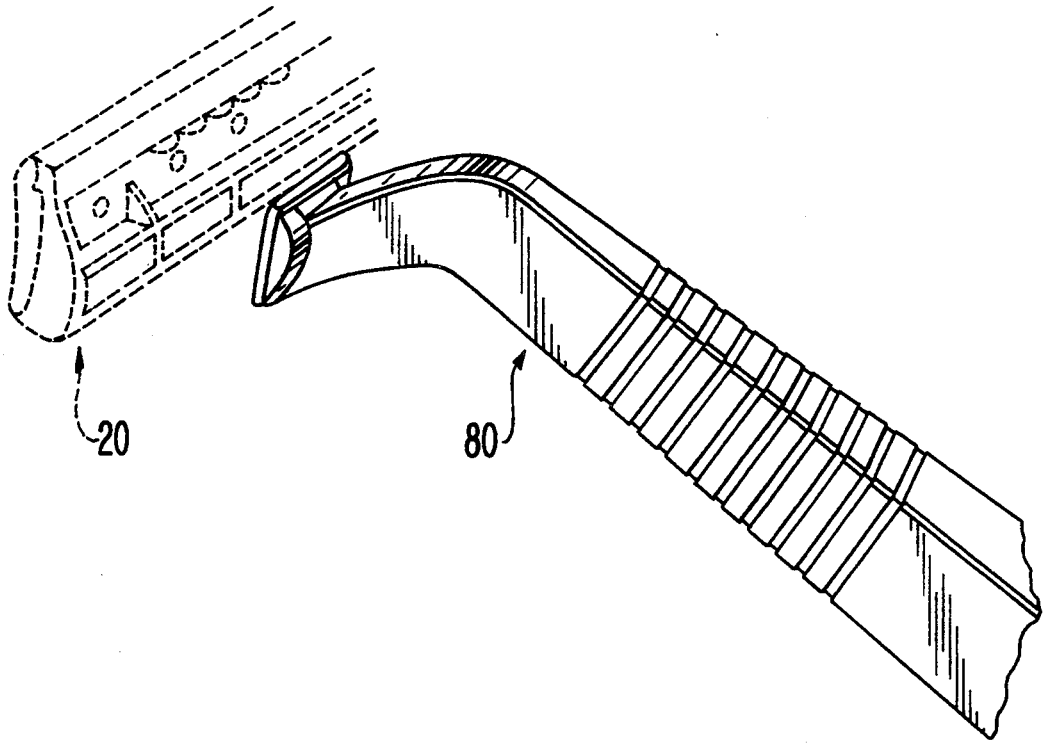
FIG. 13 shows a razor handle fixedly connected to a razor cartridge.
Figure 14:
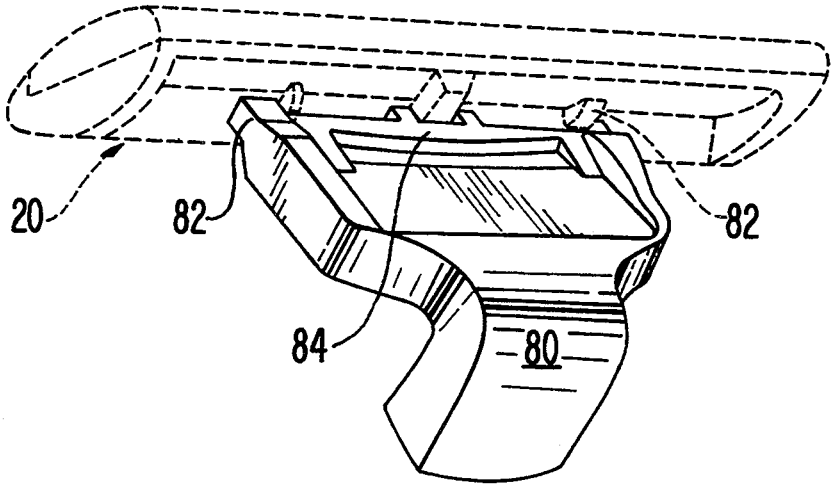
FIG. 14 shows a razor handle pivotly connected to a razor cartridge.

In yet further variation, the razor head 20 may be permanently or detachably connected to a handle 80 by suitable structures formed on the bottom surface of the razor head 20. For example, as shown in FIG. 13, the razor head 20 is attached to handle 80 in the manner described in U.S. Pat. No. 4,883,779 entitled PLATFORM, HANDLE AND SHIELD FOR SAFETY RAZOR, which issued to C. Iten and is hereby incorporated by reference. Alternatively, the razor head or shaving cartridge 20 may be mounted on a handle 80 in such a manner that it pivots or is stationary while it is used to shave a surface. For example, as illustrated in FIG. 14, a pivot connection 82 may be included near the junction of the handle 80 and the pivot connection 82 to allow the razor head to pivot about the handle 80 in response to shaving forces F. Preferably, the pivot connection 82 includes a bias member 84 which allows the razor head 20 to return to an original position in the absence of shaving forces. U.S. Pat. No. 4,094,063 entitled RAZOR ASSEMBLY WITH PIVOTALLY MOUNTED CARTRIDGE, issued to Robert A. Trotta, describes a suitable pivot connection between the razor head and handle which may be used with this invention, which is hereby incorporated by reference. Still further, it is within the spirit of this invention to detachably connect the razor head 20 to the handle 80, such as in U.S. Pat. No. 4,026,016 entitled RAZOR BLADE ASSEMBLY, issued to Warren I. Nissen, which is incorporated herein by reference.

In the preferred embodiment, the handle 80 may be connected to the body portion 20 so that the blade assembly 24 moves in a "rotational" mode relative to the guard 26 in response to shaving forces F. Alternatively, the handle 80 may be connected to the blade assembly 24 so that the guard 26 and (if the cap 28 is appropriately configured) the cap 28 moves in a "rotational" and/or "translational" sense relative to the blade assembly 24.

Figure 11A:
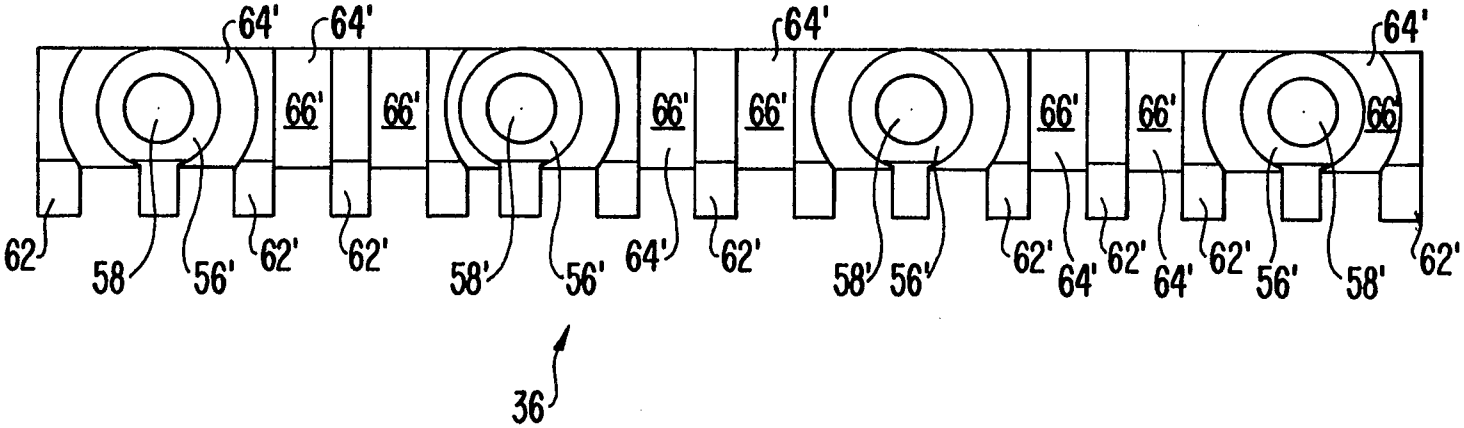
FIG. 11 shows an alternative embodiment of a blade spacer for use in the blade cartridge of the present invention.
Figure 11B:
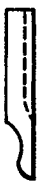

In another variation shown in FIG. 11, the spacer 36' has a plurality of oval protrusions 56' molded around a plurality of openings 58' for the rivets 42. In combination with projections 62', the protrusions 56' define channels 64' which form a plurality of tunnels 66' when blades 32,34 are mounted on the top and bottom of the spacer 36'. As described above, these tunnels 66' connect the area between the blades 32,34 with the interior of the shaving cartridge 20, thereby allowing the debris to flow away from the secondary blade 34 and be led out the back of the shaving cartridge 20 by the internal design of the cap 28 and seats 48. Conversely, water can be directed into the back of the shaving cartridge 20 to be channeled out through the front of the shaving cartridge 20 and the edges 68,70 of the blades 32,34.

In another variation, the number of blade seats 48 may vary from a single seat 48 with one or multiple pairs of double cantilever springs 52,54, or a pair of seats 48, or more than four seats 48 with each having a pair of double cantilever springs.

The embodiments described above provide a number of significant advantages. The combination of front and rear double cantilevered springs to support a blade assembly within a body portion of a shaving cartridge or the like precisely controls blade geometry in response to shaving forces.

As yet another advantage, the four-bar linkage AB,BC,CD,AD formed by the combination of rotatable front and rear double cantilever springs 44,46 connected to the stationary body portion 22 and movable blade assembly 24 translates the shaving forces F encountered from any direction into predictable blade movement in a safe direction from exposure and shave angle considerations.

Of course, it should be understood that a wide range of changes and modifications can be made to the preferred embodiment described above. It is therefore intended that the foregoing detailed description be understood that it is the following claims, including all equivalents, which are intended to define the scope of this invention.

I claim:

1. A razor head comprising a body portion defining a guard and a cap, and a blade assembly having a blade disposed therein, said blade assembly mounted by a first and second mounting member to said body portion in relation to said guard and cap in a manner to comprise a four-bar linkage, wherein said body portion defines a stationary member of said four-bar linkage, said first and second mounting members each having one end integrally connected to said body portion in a manner to define rotational members of said four-bar linkage about a separate axis of rotation for each of said first and second mounting members; and said blade assembly integrally connected to the other end of said first and second mounting members thereto to define a movable four-bar member responsive to rotational movement of said first and second mounting members so that shaving forces acting upon said blade assembly cause said blade assembly to move relative to said body portion.

2. The invention of claim 1, wherein a plurality of said mounting members connect said blade assembly to said body portion, said mounting members comprising double cantilever springs supporting a plurality of blade seats formed on said body portion to receive said blade.

3. The invention of claim 2, wherein at least four pairs of first and second mounting members affix said blade assembly to said body portion.

4. The invention of claim 1, wherein said four-bar linkage causes the angle of the blade in said blade assembly to become either more or less aggressive in response to shaving forces acting upon said blade assembly.

5. The invention of claim 1, wherein said four-bar linkage causes the blade in said blade assembly to move away either by rotational or translational movement from the shaving forces acting upon said blade.

6. The invention of claims 1, 3, 4, or 5, wherein said first and second mounting members define varying resilient characteristics between said body portion and blade assembly.

7. The invention of claim 1, wherein at least one of said mounting members includes first and second elements defining a second axis of rotation for said mounting member in manner that said body portion, said blade assembly and said first and second mounting members comprising a five-bar linkage.

8. The invention of claim 7, wherein said first and second elements of said mounting member define first and second elements having unequal radii of rotation.

9. The invention of claim 7, wherein said first and second elements of said mounting member defines one of said elements affixed to said body portion to define an axis extending beyond said body portion, and the other of said second elements defining an axis within said body portion.

10. The invention of claim 1, wherein said blade assembly includes said cap, said cap defining a lower engagement surface disposed to engage an opposed upper surface formed on said body portion which controls the limit of translational and rotational movement of said blade assembly in response to shaving forces.

11. The invention of claim 1, wherein said blade assembly includes a first and second blade.

12. The invention of claim 11, wherein said blade assembly includes a spacer affixed between said first and second blades.

13. The invention of claim 1, wherein said guard and cap are disposed at opposite sides of said body portion.

14. The invention of claim 1, wherein said razor head additionally comprises a shaving aid.

15. The invention of claim 14, wherein said shaving aid defines a lubrication strip located near said cap, said shaving aid comprising a matrix of polystyrene, and polyethylene oxide.

16. The invention of claim 1, wherein said guard includes means to allow independent movement of said guard in a direction away from the direction of shaving forces acting upon said guard.

17. The invention of claim 1, wherein said cap includes means to allow independent movement of said cap in a direction away from the direction of shaving forces acting upon said cap.

18. A razor comprising a razor head connected to a handle, said razor head including a body portion defining a guard and a cap, and a blade assembly having a blade disposed therein, said blade assembly mounted by first and second mounting members to said body portion in relation to said guard and cap in a manner to comprise a four-bar linkage, wherein said body portion defines a stationary member of said four-bar linkage, said first and second mounting members each having one end integrally connected to said body portion in a manner to define rotational members of said four-bar linkage about a separate axis of rotation for each of said first and second mounting members; and said blade assembly integrally connected to the other end of said first and second mounting members thereto to define a movable four-bar member responsive to rotational movement of said first and second mounting members so that shaving forces acting upon said blade assembly cause said blade assembly to move relative to said body portion.

19. The invention of claim 18, wherein said handle is detachably connected to said razor head.

20. The invention of claim 18, wherein said handle is permanently connected to said razor head.

21. The invention of claim 18, wherein a plurality of said mounting members connect said blade assembly to said body portion, said mounting members comprising double cantilever springs supporting a plurality of blade seats formed on said body portion to receive said blade.

22. The invention of claim 18, wherein said four-bar linkage causes the angle of the blade in said blade assembly to become either more or less aggressive in response to shaving forces acting upon said blade assembly.

23. The invention of claim 18, wherein said four-bar linkage causes the blade in said blade assembly to move away from the shaving forces acting upon said blade.

24. The invention of claims 18, 19, 20, 21, 22 or 23, wherein said first and second mounting members define varying resilient characteristics between said body portion and said blade assembly.

25. The invention of claim 19, wherein at least one of said mounting members includes first and second elements defining a second axis of rotation for said mounting member in manner that said body portion, said blade assembly and said first and second mounting members comprise a five-bar linkage.

26. The invention of claim 25, wherein said first and second elements of said mounting member define first and second elements having unequal radii of rotation.

27. The invention of claim 19, wherein said blade assembly includes a first and second blade.

28. The invention of claim 27, wherein said blade assembly includes a spacer affixed between said first and second blades.

29. The invention of claim 28, wherein said guard and cap are disposed at opposite sides of said body portion.

30. The invention of claim 19, wherein said razor head additionally comprises a shaving aid.

31. The invention of claim 30, wherein said shaving aid defines a lubrication strip located near said cap.

32. The invention of claim 19, wherein said guard includes means to allow independent movement of said guard in a direction away from the direction of shaving forces acting upon said guard.

33. The invention of claim 19, wherein said cap includes means to allow independent movement of said cap in a direction away from the direction of shaving forces acting upon said cap.

34. The invention of claim 19, wherein said first and second elements of said mounting member defines one of said elements affixed to said body portion to define an axis extending beyond said body portion, and the other of said second elements defining an axis within said body portion.

35. The invention of claim 19, wherein at least eight mounting members affix said blade assembly to said body portion.

36. The invention of claim 19, wherein said razor head defines a pivot connection allowing said razor head to pivot about the handle in response to shaving forces.

37. The invention of claim 36, wherein said pivot connection includes a bias member allowing said razor head to return to an original position in the absence of shaving forces.

38. A body portion for a blade cartridge comprising a cartridge platform mounted to said body portion by a first and second mounting member in a manner to comprise a four-bar linkage, wherein said body portion defines a stationary member of said four-bar linkage, said first and second mounting members each having one end integrally connected to said body portion in a manner to define rotational members of said four-bar linkage about a separate axis of rotation for each of said first and second mounting members; and said cartridge platform integrally connected to the other end of said first and second mounting members thereto to define a movable four-bar member responsive to rotational movement of said first and second mounting members so that shaving forces acting upon said cartridge platform cause said cartridge platform to move relative to said body portion.

39. The invention of claim 38, wherein a plurality of said mounting members connect said cartridge platform to said body portion, said mounting members comprising double cantilever springs supporting a plurality of blade seats forming said cartridge platform.

40. The invention of claim 38, wherein said four-bar linkage causes the cartridge platform in said blade assembly to move away either by rotational or translational movement from the shaving forces acting upon said cartridge platform.

41. The invention of claim 38, wherein at least one of said mounting members includes first and second elements defining a second axis of rotation for said mounting member in manner that said body portion, said cartridge platform and said first and second mounting members comprising a five-bar linkage.

42. The invention of claim 38, wherein said blade assembly comprising said cartridge platform includes a first and second blade separated by a spacer.

* * * * *

UNITED STATES PATENT AND TRADEMARK OFFICE

CERTIFICATE OF CORRECTION

PATENT NO. : 5,347,714
DATED : September 20, 1994
INVENTOR(S) : Frank H. Prochaska It is certified that error appears in the above-indentified patent and that said Letters Patent is hereby corrected as shown below:

Column 10, Line 17: "19," should read --18,--.

Column 10, Line 26: "19," should read --18,--.

Column 10, Line 33: "19," should read --18,--.

Column 10, Line 37: "19," should read --18,--.

Column 10, Line 41: "19," should read --18,--.

Column 10, Line 45: "19," should read --18,--.

Column 10, Line 51: "19," should read --18,--.

Column 10, Line 54: "19," should read --18,--.

Signed and Sealed this

Second Day of May, 1995

*Attest:*

Bruce Lehman

BRUCE LEHMAN

*Attesting Officer*

*Commissioner of Patents and Trademarks*